US005728771A

United States Patent [19]

Tang et al.

[11] Patent Number: 5,728,771

[45] Date of Patent: *Mar. 17, 1998

[54] NON-FORMALDEHYDE DURABLE PRESS FINISHING FOR CELLULOSIC TEXTILES WITH PHOSPHINOCARBOXYLIC ACID

[75] Inventors: Robert H. Tang, Murrysville; William A. Williams, Jr., Latrobe, both of Pa.

[73] Assignee: PPG Industries, Inc., Pittsburgh, Pa.

[ * ] Notice: The term of this patent shall not extend beyond the expiration date of Pat. No. 5,496,477.

[21] Appl. No.: 563,846

[22] Filed: Nov. 28, 1995

Related U.S. Application Data

[60] Division of Ser. No. 247,949, May 24, 1994, Pat. No. 5,496,477, which is a continuation-in-part of Ser. No. 192,932, Feb. 7, 1994, abandoned, which is a continuation of Ser. No. 993,577, Dec. 21, 1992, abandoned.

[51] Int. Cl.[6] ..... D06M 15/00

[52] U.S. Cl. ..... 252/8.61; 252/8.91

[58] Field of Search ..... 252/8.6, 174.16, 252/174.24, 135, 8.61, 8.91; 8/120, 127.1; 510/467, 477, 534, 434, 436

[56] References Cited

U.S. PATENT DOCUMENTS

| | | | |
|---|---|---|---|
| 4,563,284 | 1/1986 | Amjad | 210/699 |
| 4,579,676 | 4/1986 | Bull | 252/94 |
| 4,913,823 | 4/1990 | Lipinski et al. | 210/699 |
| 4,997,450 | 3/1991 | Olson et al. | 8/109 |
| 5,268,002 | 12/1993 | Olson et al. | 8/107 |
| 5,370,708 | 12/1994 | Olson et al. | 8/108.1 |
| 5,447,537 | 9/1995 | Choi | 8/115.6 |
| 5,562,740 | 10/1996 | Cook et al. | 8/120 |

FOREIGN PATENT DOCUMENTS

| | | |
|---|---|---|
| 32343 | 4/1990 | Australia . |

*Primary Examiner*—Paul Lieberman
*Assistant Examiner*—John R. Hardee
*Attorney, Agent, or Firm*—Irwin M. Stein

[57] ABSTRACT

A composition and method for providing a non-formaldehyde durable press finish to cellulosic fabrics by employing polyphosphinocarboxylic acids are disclosed. The polyphosphinocarboxylic acid is preferably polyphosphinoacrylic acid, and is optimally used in combination with phosphonoalkylpolycarboxylic acid, and, for cost effectiveness, a low-cost polycarboxylic acid such as citric acid. The catalyst for the curing reaction is preferably a phosphorus-containing acid or alkali metal salt thereof such as a mixture of sodium monophosphate and sodium hypophosphite.

10 Claims, No Drawings

NON-FORMALDEHYDE DURABLE PRESS FINISHING FOR CELLULOSIC TEXTILES WITH PHOSPHINOCARBOXYLIC ACID

CROSS REFERENCE TO RELATED APPLICATIONS

This is a division of application Ser. No. 08/247,949 filed on May 24, 1994, now U.S. Pat. No. 5,496,477, which is a continuation-in-part of Ser. No. 08/192,932 filed on Feb. 7, 1994, abandoned, which is a continuation of Ser. No. 07/993,577 filed Dec. 21, 1992, abandoned.

The present invention relates generally to the art of durable press finishing for cellulosic textiles and more particularly to the art of formaldehyde-free durable press finishing for cellulosic textiles.

Various commercial processes for imparting durable press properties to cellulose-containing fabrics use formaldehyde or formaldehyde derivatives together with acid catalysts to crosslink the cellulose of cotton fibers upon the application of heat. These durable press agents are effective and inexpensive, but produce undesirable results such as release of formaldehyde vapors, which are irritating if not dangerous, and loss of strength in the fabric due to degradation of cellulosics by acid cleavage of polymeric chains at high temperatures.

U.S. Pat. No. 3,526,048 to Rowland et al. describes crosslinking fibrous materials comprising cellulose by treating such materials with a polycarboxylic acid having various amounts of the carboxylic acid function neutralized with an alkali metal hydroxide, ammonium hydroxide or amine, and heating the treated cellulose to induce esterification and concurrent crosslinking. The polycarboxylic acid must contain no functional groups except carboxyl, and must contain at least three free carboxylic groups, each carboxyl group attached to a separate carbon atom, and at least two of the carboxyl groups separated by no more than one carbon atom.

A formaldehyde-free durable press finishing process is also described in U.S. Pat. No. 4,820,307 to Welch et al. In that process, fibrous cellulose in textile form is esterified and crosslinked by polycarboxylic acids such as butane-1,2,3,4-tetracarboxylic acid (BTCA) at elevated temperatures using catalysts which are acidic or weakly basic salts such as alkali metal dihydrogen phosphates and alkali metal salts of phosphorous, hypophosphorous and polyphosphoric acids.

U.S. Pat. No. 5,273,549 to Didier et al. discloses use as cellulose cross-linking agents of derivatives of alkanepolycarboxylic acids of the general formula

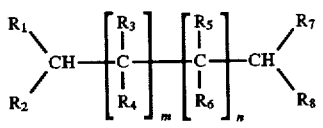

wherein m and n are zero or one, $R_1$, $R_3$, $R_5$ and $R_7$ are H or COOH, at least two being COOH, $R_2$, $R_4$, $R_6$ and $R_8$ are H or PO(OH)(OR) where R is H or $C_{1-4}$ alkyl, only one being PO(OH)(OR).

The present invention provides durable press fabric finishing without the generation of formaldehyde by means of a cellulose crosslinking system containing polyphosphinocarboxylic acid and a catalyst. The durable press finishing of the present invention provides durable press performance equal to that of dimethylol dihydroxy ethylene urea (DMDHEU) without the generation of formaldehyde during processing or release of formaldehyde from treated fabrics.

Moreover, while fabrics treated in accordance with the present invention exhibit durable press performance equal to that of DMDHEU or BTCA, they also exhibit from about 10 to about 20 percent better retention of fabric strength.

The formaldehyde-free durable press crosslinking system of the present invention comprises a mixture of a polyphosphinocarboxylic acid and an esterification catalyst. The polyphosphinocarboxylic acid is preferably a low molecular weight polyphosphinoacrylic acid, e.g. having a weight average molecular weight less than about 8000 and the general formula

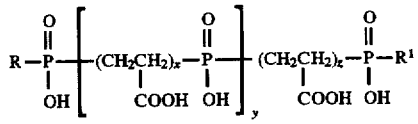

wherein R and $R^1$ are independently H or OH and x, y and z are selected to yield the desired molecular weight and proportion of phosphinate functional groups. Some of the terminal groups may be carboxylate, but most are preferably phosphonate as illustrated above. Polyphosphinoacrylic acid may be prepared by the reaction of acrylic acid and sodium hypophosphite in the presence of a free radical initiator. For example, low molecular weight polyphosphinoacrylic acid may be prepared by slow addition of acrylic acid to an aqueous solution of sodium hypophosphite containing a catalytic amount of potassium persulfate at 90° C. to 95° C. under nitrogen atmosphere. The preferred polyphosphinoacrylic acids have a molecular weight less than 8000, e.g. 300 to 5000, preferably 1500 to 3500. Reaction products prepared at 40 percent solids are clear to slightly hazy aqueous solutions with a pH of 2.5 to 3.0. By varying the concentration of sodium hypophosphite and rate of acrylic acid addition, products having molecular weights from 1500 to 5000 are readily obtained.

Esterification catalysts may include oxalic acid, phosphonic acids, organic phosphonates, alkali metal sulfides, paratoluene sulfonic acid, and acidic or weakly basic salts such as alkali metal dihydrogen phosphates and alkali metal salts of a phosphorus-containing acid such as phosphorous acid, hypophosphorous acid and polyphosphoric acid. The alkali metal salts may include lithium, sodium and potassium salts. Ammonium salts may also be used. Most of the catalysts are weak bases, i.e. alkali metal salts of stronger acids than ortho-phosphoric acid. Preferred catalysts include alkali metal hypophosphites, phosphites and monophosphates, as well as phosphorous, hypophosphorous and polyphosphoric acids, and mixtures thereof.

Sodium hypophosphite and sodium monophosphate are preferred catalysts, particularly in combination. While any proportions of sodium monophosphate and sodium hypophosphite may be used, from 100 percent sodium monophosphate through a 50/50 mixture to 100 percent sodium hypophosphite, a preferred range of proportions is from 5:1 to 1:3 by weight of sodium monophosphate to sodium hypophosphite, each in the monohydrate form. Phosphorous acid is also a preferred catalyst.

The amount of catalyst used is that amount which is effective to catalyze the esterification reaction which crosslinks the cellulose, i.e. a catalytic amount. Generally, from 1 to 25 weight percent, e.g. 4 to 12 weight percent, of the catalyst based on the durable press composition may be useful. A ratio of 3:1 sodium monophosphate to sodium hypophosphite is preferred, particularly when the catalyst is used in the preferred range of 4 to 12 percent based on the weight of the durable press composition, i.e. the aqueous solution.

While the polyphosphinocarboxylic acid, e.g. polyphosphinoacrylic acid, alone provides adequate durable press performance for some applications, it is preferred to employ the polyphosphinocarboxylic acid in combination with at least one other polycarboxylic acid. The second polycarboxylic acid may be an alkyl polycarboxylic acid such as BTCA, but is preferably a phosphonoalkyl polycarboxylic acid. The phosphonoalkylpolycarboxylic acid comprises an alkyl chain, preferably comprising from 3 to about 8 carbon atoms, at least one phosphono group attached to one of said carbon atoms, and at least two, preferably from 3 to 6, carboxyl groups, attached to said carbon atoms. Phosphonopropane polycarboxylic acids may be prepared by the reaction of 1,2,3,propane tricarboxylic acid with hypophosphorous acid or sodium hypophosphite. Phosphonoalkyl polycarboxylic acids of the formula

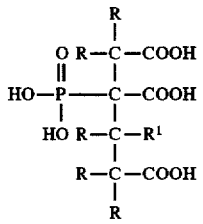

wherein R is hydrogen or lower alkyl and R' is hydrogen, lower alkyl or carboxyl are particularly useful in the formaldehyde-free durable press crosslinking system in accordance with the present invention. Various useful compounds are disclosed in U.S. Pat. No. 5,273,549. U.S. Pat. Nos. 3,886,204 and 3,886,205 describe the production of 2-phosphonobutane-1,2,3,4-tetracarboxylic acids and 2-phosphono-butane-1,2,4,tricarboxylic acids respectively. Preferred phosphonoalkyl polycarboxylic acids include 2-phosphonobutane-1,2,4-tricarboxylic acid (PBTC) and phosphonosuccinic acid.

The ratio of polyphosphinocarboxylic acid, e.g. polyphosphinoacrylic acid to polycarboxylic acid, e.g. phosphonoalkylpolycarboxylic acid, in the durable press composition is not critical. However, the durable press finish performance of phosphonoalkylpolycarboxylic acid is superior to that of polyphosphinoacrylic acid, but currently at a higher cost. Thus the proportion of polyphosphinocarboxylic acid is a cost/performance choice. Preferably, the composition comprises at least 10 mole percent of polyphosphinoacrylic acid and at least 10 mole percent of phosphonoalkylpolycarboxylic acid.

Even polyphosphinoacrylic acids, especially the more preferred low molecular weight polyphosphinoacrylic acids, are more expensive than hydroxypolycarboxylic acids such as citric acid. It may be useful therefore to include in the durable press compositions of the present invention a low cost durable press agent such as citric acid. This agent is not essential to performance, but is added to maintain performance at lower cost. Thus the proportion of hydroxypolycarboxylic acid is not critical. The amount added is limited primarily by the tendency of the hydroxypolycarboxylic acid to cause fabric discoloration. In general, it is preferred to use no more than 50 mole percent of a low cost hydroxypolycarboxylic acid such as citric acid. Other polycarboxylic acids may be included in the durable press compositions of this invention. Examples of such polycarboxylic acids include maleic acid, citraconic acid, succinic acid, itaconic acid, 1,2,3-propane-tricarboxylic acid, trans-aconitic acid, butanetricarboxylic acid, butane tetracarboxylic acid, cyclopentanetetracarboxylic acid, mellitic acid, oxydisuccinic acid and thiodisuccinic acid.

Preferred durable press finish compositions of the present invention comprise polyphosphinoacrylic acid in combination with both a phosphonoalkylcarboxylic acid, preferably PBTC, and a low cost hydroxypolycarboxylic acid, preferably citric acid. Such compositions preferably comprise 25 to 50 mole percent polyphosphinoacrylic acid, at least 10 mole percent phosphonoalkylpolycarboxylic acid, and no more than 50 mole percent hydroxypolycarboxylic acid. More preferred compositions comprise 30 to 50 mole percent polyphosphinoacrylic acid, 10 to 50 mole percent of phosphonoalkylpolycarboxylic acid, e.g. phosphonobutane tricarboxylic acid, and 10 to 40 mole percent of hydroxypolycarboxylic acid, e.g. citric acid. Particularly preferred compositions comprise 40 to 50 mole percent polyphosphinoacrylic acid, 35 to 40 mole percent 2-phosphonobutane-1,2,4-tricarboxylic acid and 10 to 25 mole percent citric acid. Other polycarboxylic acids may be included, with the total of all polycarboxylic acid constituents adding up to 100 mole percent.

The compositions of the present inventions are prepared as concentrated aqueous solutions, typically 30 to 60 weight percent solids. Such a solution is generally diluted with water prior to use, thereby resulting in a final concentration of from about 1 to about 25 percent solids for application to the fabric. Concentrations from about 2 to about 20 percent, particularly 5 to 15 percent, are preferred.

The method of fabric treatment is generally to immerse the fabric in a bath of the composition and squeeze out the excess liquid by running the fabric through a pair of rollers. This typically results in a wet pick-up of about 80 to 100 weight percent. The fabric may be dried and cured in two steps, but is conventionally "flash-cured" in one step by heating at a sufficient temperature for a sufficient time to crosslink the cellulose fibers. Generally, temperatures between about 130° C. and 200° C. may be used. Typically, a temperature of from about 155° C. to about 185° C. for a period of about 3 to about 10 minutes is sufficient. A preferred cure cycle for the compositions of the present invention is 170° C. to 175° C. for about 5 to 10 minutes.

The compositions and method of the present invention are applicable to cellulosic fibers in general, such as jute, ramie and linen. Natural cotton fabrics are effectively treated by the compositions and methods of the present invention. Blends of cotton and synthetic fibers such as polyester and polyamide may also be treated effectively. Cotton/polyester blends ranging from 20/80 to 80/20, particularly the common 50/50 and 65/35, are effectively treated in accordance with the present invention. Other cellulosic fibers and fabrics made therefrom, such as rayon and cellulose acetate, may also be treated in accordance with the present invention. Knit fabrics, as well as woven, cotton and cotton/polyamide blends for example, may be treated in accordance with the present invention.

Treated fabrics are evaluated for durable press performance by AATCC Test Method 124-1984, and given DP ratings from 1 to 5 based on their appearance. This procedure is designed to measure the relative effectiveness of durable press resins on cellulosic fabrics under conditions designed to simulate consumer care and usage. The fabric used is 100 percent cotton broadcloth, Style 419 from Testfabrics, Inc. Three pieces of cotton broadcloth, 12"×14" (30.5×35.6 centimeters), are cut for each composition to be tested. Each is soaked individually in test solution for at least 30 seconds and run through a two roll vertical pad at 1 bar pressure. The fabric is rewet and passed through the pad a second time. The wet weight minus dry weight is recorded as wet pick-up in percent based on dry weight. The treated fabric is mounted on pin frames and adjusted to 3 kilopascals tension, and cured in all of the examples herein at 175° C. for 5 minutes. After the fabric is dried and conditioned for 2 hours, it is rated initially by comparison against AATCC 3-D Durable Press Replicas. Samples are mounted such that the center of the samples and standards is 5 feet off the ground. Evaluation is in a darkened room with samples illuminated by an overhead fluorescent light. Observers are 4 feet away, and ratings by at least three observers are averaged. Thereafter, the fabric is washed and dried a total of 5 times using full ballast, 90 grams AATCC standard detergent 124, wash water at 120° F. (49° C.)±5°, rinse water at 85° F. (29.4° C.)±5° and normal washer and drier settings. After the last dry cycle, the fabric is removed and conditioned at least 2 hours before final rating. The DP ratings from 1 to 5 are described below.

DP-5 is a very smooth, pressed, finished appearance.

DP-4 is a smooth, finished appearance.

DP-3.5 is a fairly smooth but nonpressed appearance.

DP-3 is a mussed, nonpressed appearance.

DP-2 is a rumpled, obviously wrinkled appearance.

DP-1 is a crumpled, creased and severely wrinkled appearance.

Retention of fabric strength is evaluated by the Mullen Burst Test, and Mullen burst strengths are given in pounds per square inch. The Mullen Burst Test measures the force required to drive an air actuated piston through test material to determine relative material strength. The material to be tested is clamped in a ring holder. The piston is turned on and the pressure rises until failure occurs. The test is repeated four times at different points on the test material and the results are averaged.

The present invention will be further understood from the descriptions of examples of the present invention, as well as comparative examples of the prior art, which follow.

EXAMPLE 1

A solution was prepared by dissolving 19.0 grams of polyphosphinoacrylic acid (PPAA) and 8.1 grams of sodium hypophosphite monohydrate (SHP) in water to 100 grams. The PPAA was an aqueous solution containing 38.6 percent solids of polyphosphinoacrylic acid having a molecular weight of about 1500, as measured by gel permeation chromatography (GPC). The resulting solution was clear with a pH of 2.75. Cotton fabric was treated with the solution to a wet pick-up of 86.3 percent. The treated fabric was cured at 175° C. for 5 minutes. The initial DP rating was 3.5, and the DP rating was 3.2 after five wash-dry cycles. The Mullen burst strength was 96.8 pounds per square inch.

EXAMPLE 2

A solution was prepared by dissolving 22.3 grams of PPAA as in Example 1 and 8.9 grams of concentrated phosphoric acid in water to 95 grams. The solution was neutralized with 5 grams of 50 percent NaOH to a final pH of 2.57. Cotton fabric was treated with the solution to a wet pick-up of 91.4 percent. The treated fabric was cured at 175° C. for 5 minutes. The initial DP rating was 4.0, and the DP rating was 3.0 after five wash-dry cycles. The Mullen burst strength was 77.6 pounds per square inch.

EXAMPLE 3

A solution was prepared by dissolving 18.5 grams of PPAA and 4.1 grams SHP in water to 100 grams. The PPAA was an aqueous solution of 40.7 percent solids of polyphosphinoacrylic acid having a molecular weight of 2600 as measured by GPC. The solution was clear with pH 2.75. Cotton fabric was treated with the solution to a wet pick-up of 79.3 percent. The treated fabric was cured at 175° C. for 5 minutes. The initial DP rating was 3.0, and the DP rating was 3.0 after five wash-dry cycles. The Mullen burst strength was 114 pounds per square inch.

COMPARATIVE EXAMPLE A

A solution was prepared by dissolving 13.5 grams of polyacrylic acid (PAA) and 8.9 grams of concentrated phosphoric acid in water to 95 grams. The PAA was an aqueous solution containing 55 percent solids of polyacrylic acid having a molecular weight of 2100. The solution was neutralized with 3.8 grams of 50 percent NaOH to a final pH of 2.53. Cotton fabric was treated with the solution to a wet pick-up of 91.1 percent. The treated fabric was cured at 175° C. for 5 minutes. The initial DP rating was 3.8, and the DP rating was 1.0 after five wash-dry cycles. The Mullen burst strength was 50 pounds per square inch.

COMPARATIVE EXAMPLE B

A solution was prepared by dissolving 15.4 grams of polyacrylic acid (PAA) and 8.9 grams of phosphoric acid in water to 95 grams. The PAA was a 48 percent aqueous solution of polyacrylic acid having a molecular weight of 6300. The solution was neutralized with 4.2 grams of 50 percent NaOH to a final pH of 2.85. Cotton fabric was treated with the solution to a wet pick-up of 86.0 percent. The treated fabric was cured at 175° C. for 5 minutes. The initial DP rating was 3.5, and the DP rating was 1.0 after five wash-dry cycles. The Mullen burst strength was 53.2 pounds per square inch.

COMPARATIVE EXAMPLE C

A solution was prepared by dissolving 32.6 grams of polyacrylic acid (PAA) and 14.0 grams of SHP in water to 200 grams. The PAA was a 50 percent aqueous solution of polyacrylic acid having a molecular weight of 4700. Cotton fabric was treated with the solution to a wet pick-up of 91.2 percent. The treated fabric was cured at 170° C. for 7 minutes. The initial DP rating was 3.8, and the DP rating was 1.0 after five wash-dry cycles. Mullen burst strength was not measured.

A summary of the DP ratings and Mullen burst strengths for Examples 1 to 3 of the present invention and Comparative Examples A to C are presented in the following table.

TABLE

| | | | DP Rating | | Burst |
|---|---|---|---|---|---|
| Example | DP Agent | MW | Prewash | 5 Washes | (pounds/in$^2$) |
| 1 | PPAA | 1500 | 3.5 | 3.2 | 96.8 |
| 2 | PPAA | 1500 | 4.0 | 3.0 | 77.6 |
| 3 | PPAA | 2600 | 3.0 | 3.0 | 114.0 |
| A | PAA | 2100 | 3.8 | 1.0 | 50.0 |
| B | PAA | 6300 | 3.5 | 1.0 | 53.2 |
| C | PAA | 4700 | 3.8 | 1.0 | — |

The above results illustrate the effectiveness of the compositions and methods of the present invention. Various fabrics may be treated with a range of components and concentrations and cured at other temperatures for different times without departing from the scope of this invention, which is defined by the following claims.

We claim:

1. A formaldehyde-free durable press finish composition for treating cellulose-containing fibrous materials consisting essentially of an aqueous solution of polycarboxylic acid, said polycarboxylic acid aqueous solution comprising at least 10 mole percent polyphosphinocarboxylic acid, and from 4 to 12 weight percent of an esterification catalyst that catalyzes the esterification of the cellulose with the polycarboxylic acid.

2. The composition of claim 1 wherein the polyphosphinocarboxylic acid is polyphosphinoacrylic acid having a weight average molecular weight of less than 8000.

3. The composition of claim 2 wherein the esterification catalyst is selected from the group consisting of alkali metal hypophosphites, alkali metal phosphites, alkali metal monophosphates, phosphorous acid, hypophosphorous acid, polyphosphoric acid and mixtures thereof.

4. The composition of claim 3 wherein the esterification catalyst is selected from the group consisting of sodium monophosphate, sodium hypophosphite and mixtures thereof.

5. The composition of claim 4 wherein the weight ratio of sodium monophosphate to sodium hypophosphite in the mixture is from 5:1 to 1:3.

6. The composition of claim 1 wherein the polyphosphinocarboxylic acid is polyphosphinoacrylic acid having a weight average molecular weight of from 300 to 5000, and the esterification catalyst is selected from the group consisting of alkali metal hypophosphites, alkali metal phosphites, alkali metal monophosphates, phosphorous acid, hypophosphorous acid, polyphosphoric acid and mixtures thereof.

7. The composition of claim 6 wherein the esterification catalyst is selected from the group consisting of sodium monophosphate, sodium hypophosphite and mixtures thereof, the weight ratio of said sodium monophosphate to sodium hypophosphite in mixture being from 5:1 to 1:3.

8. The composition of claim 7 wherein the polyphosphinoacrylic acid has a weight average molecular weight of from 1500 to 3500.

9. The composition of claim 8 wherein the catalyst is present in amounts of from 4 to 12 weight percent, based on the weight of the aqueous treating solution.

10. The composition of claim 5 wherein the catalyst is present in amounts of from 4 to 12 weight percent, based on the weight of the aqueous treating solution.

* * * * *